US008870688B2

(12) United States Patent
Verrengia et al.

(10) Patent No.: US 8,870,688 B2
(45) **Date of Patent: *Oct. 28, 2014**

(54) BAT HAVING FIBER-FUSED CORE SECTION AND METHOD OF MANUFACTURING THE SAME

(75) Inventors: Thomas M. Verrengia, Staten Island, NY (US); Lilian Bao, Fujian (CN); Yanshen Hsu, Staten Island, NY (US)

(73) Assignee: Pinnacle Sports Equipment Co. Inc., Staten Island, NY (US)

( * ) Notice: Subject to any disclaimer, the term of this patent is extended or adjusted under 35 U.S.C. 154(b) by 129 days.

This patent is subject to a terminal disclaimer.

(21) Appl. No.: 13/165,201

(22) Filed: Jun. 21, 2011

(65) Prior Publication Data

US 2011/0312452 A1 Dec. 22, 2011

Related U.S. Application Data

(63) Continuation-in-part of application No. 12/824,634, filed on Jun. 28, 2010, now Pat. No. 8,257,207, which is a continuation of application No. 12/265,278, filed on Nov. 5, 2008, now Pat. No. 7,771,296.

(51) Int. Cl.

| | |
|---|---|
| ***A63B 59/06*** | (2006.01) |
| ***B27N 3/04*** | (2006.01) |
| ***B27N 5/00*** | (2006.01) |
| *A63B 59/02* | (2006.01) |
| *A63B 59/00* | (2006.01) |
| *A63B 59/12* | (2006.01) |

(52) U.S. Cl.

CPC . *A63B 59/06* (2013.01); *B27N 3/04* (2013.01); *A63B 59/02* (2013.01); *A63B 59/0014* (2013.01); *B27N 5/00* (2013.01); *A63B 59/12* (2013.01); *A63B 2209/023* (2013.01); *A63B 2209/00* (2013.01)

USPC ..... 473/564; 273/402; 473/570

(58) Field of Classification Search

USPC ..... 473/519, 520, 564–568, 457

See application file for complete search history.

(56) References Cited

U.S. PATENT DOCUMENTS

| | | | | |
|---|---|---|---|---|
| 310,248 | A * | 1/1885 | Brown | 473/564 |
| 1,121,189 | A * | 12/1914 | Lincoln | 473/564 |
| 1,549,803 | A * | 8/1925 | Rastetter | 473/564 |
| 1,601,915 | A * | 10/1926 | Hillerich | 473/564 |
| 2,379,006 | A * | 6/1945 | Johnson | 473/568 |
| 5,476,706 | A * | 12/1995 | Shimizu | 428/136 |
| 5,620,179 | A * | 4/1997 | MacKay, Jr. | 473/564 |
| 5,743,809 | A * | 4/1998 | Lehman | 473/300 |
| 6,007,440 | A * | 12/1999 | Bender et al. | 473/564 |
| 6,152,840 | A * | 11/2000 | Baum | 473/564 |
| 6,334,823 | B1 * | 1/2002 | Holman | 473/564 |
| 6,827,659 | B1 * | 12/2004 | Chen | 473/564 |
| 6,878,080 | B2 * | 4/2005 | Chang | 473/564 |

(Continued)

*Primary Examiner* — Mark Graham

(74) *Attorney, Agent, or Firm* — Scully, Scott, Murphy & Presser, P.C.

(57) ABSTRACT

A bat has a core section made from wood or grass material fibers artificially fused together and an outer section for substantially surrounding the core section. The core section can be made exclusively of bamboo fibers artificially fused together. The outer section has opposite bottom and top subsections and opposite side subsections, adhered to corresponding sides of the core section. The outer section can be made of bamboo strips. The bat also has an insert or plug made of a wood material. The insert or plug is disposed in a void provided in a distal end portion of the bat.

12 Claims, 12 Drawing Sheets

(56) References Cited

U.S. PATENT DOCUMENTS

| | | | | |
|---|---|---|---|---|
| 7,052,419 | B2 * | 5/2006 | Chang | 473/566 |
| 7,399,242 | B1 * | 7/2008 | Smith | 473/457 |
| 7,771,296 | B2 * | 8/2010 | Verrengia et al. | 473/564 |
| 7,846,295 | B1 * | 12/2010 | Medoff | 162/50 |
| 8,257,207 | B2 * | 9/2012 | Verrengia et al. | 473/564 |
| 2004/0029660 | A1 * | 2/2004 | Chen et al. | 473/564 |
| 2005/0059515 | A1 * | 3/2005 | Chang | 473/564 |
| 2005/0127567 | A1 * | 6/2005 | Davies | 264/322 |
| 2006/0030437 | A1 * | 2/2006 | Bao et al. | 473/564 |
| 2007/0232422 | A1 * | 10/2007 | Chang | 473/564 |
| 2008/0176025 | A1 * | 7/2008 | Xu | 428/106 |
| 2009/0130377 | A1 * | 5/2009 | Samanta et al. | 428/113 |
| 2009/0275428 | A1 * | 11/2009 | Ikeda et al. | 473/564 |

* cited by examiner

BAT HAVING FIBER-FUSED CORE SECTION AND METHOD OF MANUFACTURING THE SAME

CROSS REFERENCE TO RELATED APPLICATIONS

The present application is a continuation-in-part application of U.S. Ser. No. 12/824,634, filed on Jun. 28, 2010, which is a continuation application of U.S. Ser. No. 12/265,278, filed on Nov. 5, 2008, the entire contents of which are incorporated herein by reference.

BACKGROUND

1. Field

The current disclosure relates generally to bats, such as baseball bats, and a method for manufacturing bats, and more particularly, to bats with core sections thereof fabricated from grass or wood material fibers artificially fused together and a method for manufacturing bats having fiber-fused cores.

2. Prior Art

FIG. 1 and FIG. 2 illustrate a traditional technique for fabricating wood baseball bats. This technique can also be used to fabricate baseball bats from grass materials, such as bamboo. FIG. 1 illustrates a baseball bat blank 100 and FIG. 2 illustrates a sectional view of the blank 100 taken along lines 2-2 in FIG. 1. The blank 100 includes of a plurality of wood strips 102, each of which is typically about 10 mm thick by 900 mm long. The wood strips 102 are glued together to form the blank 100, which is typically about 70 mm by 70 mm in cross-section. As shown in FIG. 2, the strips 102 are typically adhered in a staggered pattern. The blank 100 is processed to form a finished baseball bat.

According to the existing industry standard, a baseball bat is around 25 mm in diameter at the thinnest part thereof, where the baseball bat is most prone to breakage during use. One reason leading to failure of the baseball bat is that the symmetricalness of the bat relative to the central axis of the bat is not satisfactory and, accordingly, the baseball bat is anisotropic in mechanical performance. Another reason is that the strength of the core section of the bat, which substantially runs through the entire length of the bat, is not satisfactory.

In addition, due to the intense market competition, manufacturers of wood baseball bats are offering warranties against breakage for a predetermined period of time, for example, 30 days. However, the current warranties cannot meet the expectations of the consumers.

Therefore, it is desirable to provide a bat made of wood and/or grass materials, with improved symmetricalness relative to the central axis and an improved core section, which is strong, solid and unified. Accordingly, warranties against breakage for a longer time can be offered to the consumers.

SUMMARY OF THE DISCLOSURE

As described herein, the exemplary embodiments of the present invention overcome one or more of the above or other disadvantages known in the art.

According to an exemplary aspect of the present invention, an elongated wooden article, particularly a bat, is provided. The article extends along a longitudinal axis and has a distal end and a proximal end along the axis. The article comprises an elongated core section extending along the axis, the core section comprising wood or grass material fibers artificially fused together. The article further comprises an outer section extending along the axis, the outer section substantially surrounding the core section. The article further comprises a void provided in a distal end portion of the article and an insert disposed in the void. For example, the core section consists of bamboo fibers artificially fused together and the insert is made of a wood material.

According to another exemplary aspect of the present invention, an elongated wooden article, particularly a bat, is provided. The article extends along a longitudinal axis and has a distal end and a proximal end along the axis. The article comprises an elongated core section extending along the axis, the core section comprising wood or grass material fibers artificially fused together. The article further comprises a plug longitudinally distanced from the core section. The article further comprises an outer section extending along the axis, the outer section substantially surrounding the core section and the plug to define an inner space between the core section and the plug. For example, the core section consists of bamboo fibers artificially fused together and the plug is made of a wood material.

According to still another exemplary aspect of the present invention, a method for forming an elongated wooden article, particularly a bat, is provided. The method comprises constructing a core section, constructing an outer section for substantially surrounding the core section, bonding outer section to the core section to form a blank, processing the blank into a predetermined form of the article having a distal end and a proximal end, forming a void in a distal end portion of the article, and filling the void with an insert.

According to still another exemplary aspect of the present invention, a method for forming an elongated wooden article, particularly a bat, is provided. The method comprises constructing a core section, constructing a plug, constructing an outer section for substantially surrounding the core section and the plug, bonding the outer section to the core section and plug to form a blank having an inner space between the core section and the plug, and processing the blank into a predetermined form of the article having a distal end and a proximal end.

BRIEF DESCRIPTION OF THE DRAWINGS

These and other features, aspects, and advantages of the products and methods of the present invention will become better understood with regard to the following description, appended claims, and accompanying drawings where:

DETAILED DESCRIPTION

Although this invention is applicable to numerous and various types of suitable wood or grass materials for use in baseball bats, it has been found particularly useful in the environment of bamboo. Therefore, without limiting the applicability of the invention to bamboo, the invention will be described in such an environment. Furthermore, the inventive concept of the invention is not intended to be limited to any particular bat or club, and the invention can be applied to, for example, baseball bats, softball bats, fungo bats, training bats and the like. Moreover, the inventive concept of the invention is not limited to bats for hitting an object during sports, but can be applied to any suitable elongated wooden article useable for a varieties of purposes, such as lacrosse sticks, hockey sticks, axe handles, shovel handles and the like. In addition, the blank and bat configurations described in the following exemplary embodiments are just for illustrative and descriptive purpose, and should not be understood as limiting, by any sense.

Figure 1:
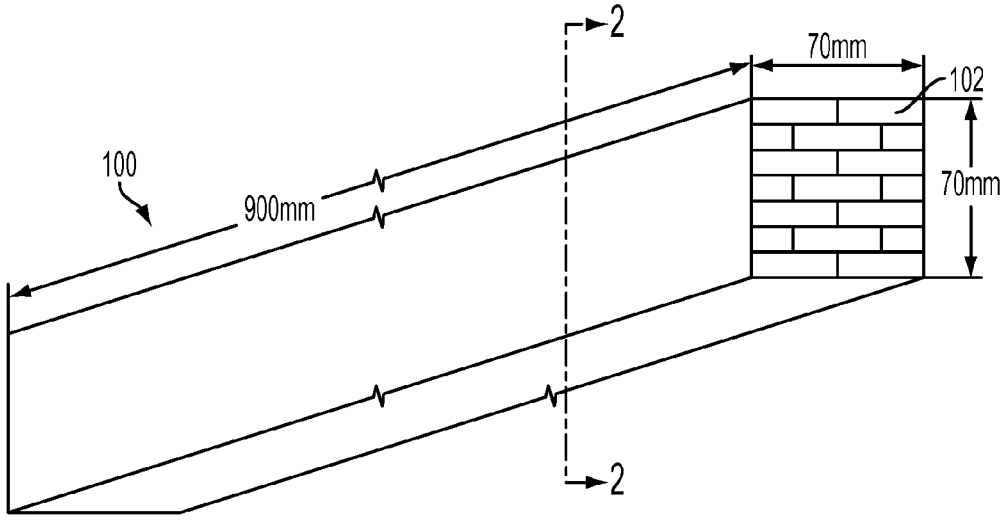
FIG. 1 (PRIOR ART)
FIG. 1 is a perspective view of a blank according to the prior art from which a bat is fabricated.
Figure 2:
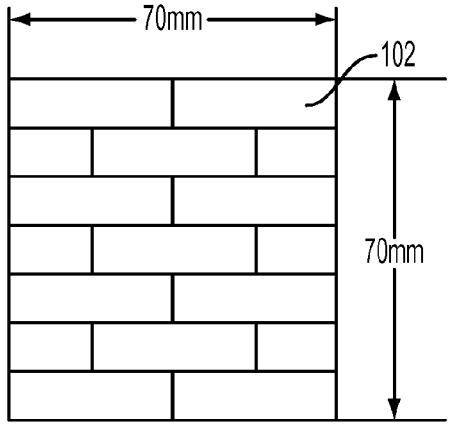
FIG. 2 (PRIOR ART)
FIG. 2 is a sectional view of the blank of FIG. 1 as taken along lines 2-2 in FIG. 1.
Figure 3:
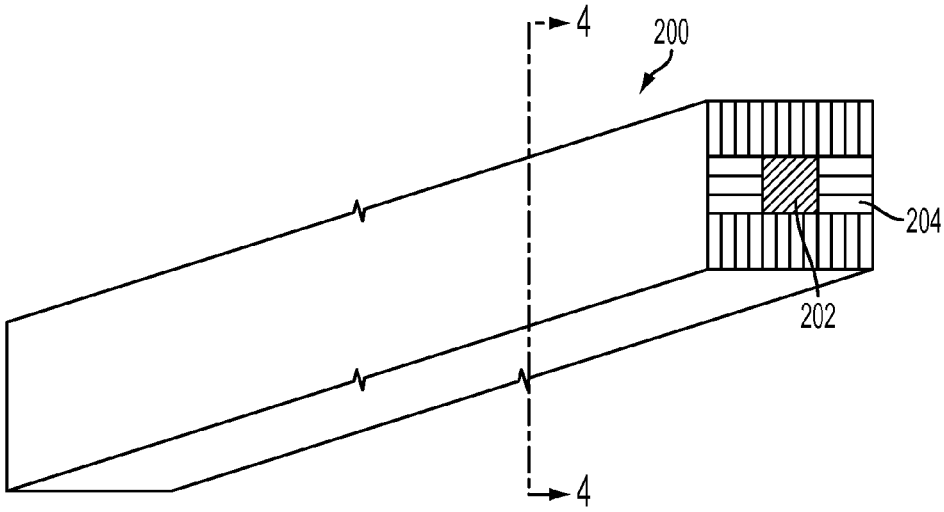
FIG. 3 is a perspective view of a blank having a fiber-fused core section, according to an exemplary embodiment of the present invention.

FIG. 3 illustrates an exemplary embodiment of a blank from which a baseball bat is fabricated, identified by reference numeral 200. The blank 200 includes a core section 202, which is a unitary and solid core section made of wood or grass fibers artificially fused together. The wood material suitable for the core section includes but is not limited to maple, ash, birch and the like. The grass material suitable for the core section includes but is not limited to bamboo. The process for manufacturing the fiber-fused core section 202 will be described later in detail. The blank 200 further includes an outer section 204 substantially surrounding the core section 202 and integrated with the core section 202 through any known means, such as glue bonding.

Figure 4:
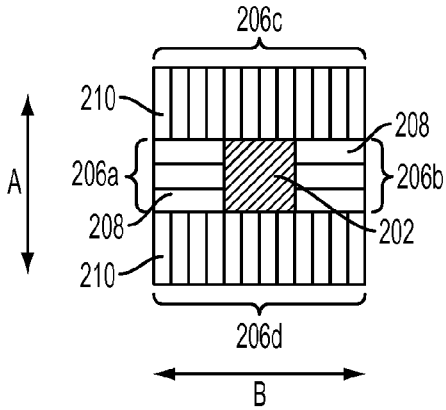
FIG. 4 is a sectional view of the blank of FIG. 3 as taken along lines 4-4 of FIG. 3.
Figure 5:
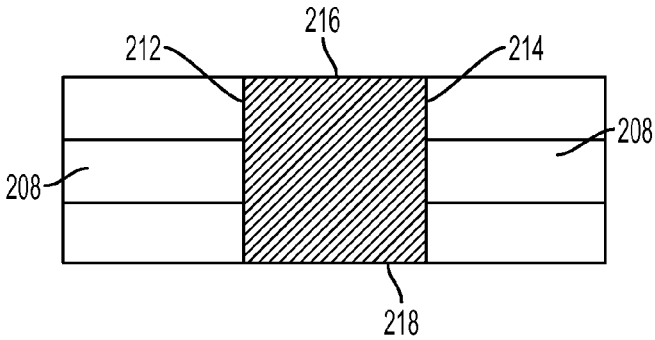
FIG. 5 is an enlarged sectional view of a middle layer of the blank shown in FIG. 3 and FIG. 4.

FIG. 4 is a sectional view of the blank 200 along lines 4-4 of FIG. 3 and FIG. 5 is an enlarged view of the middle layer of the blank 200 shown in FIG. 4, both illustrating the detailed structure of the core section 202 and the outer section 204.

The core section 202 has, for example, a substantially square cross section defined by a pair of opposite left side 212 and right side 214 and a pair of opposite top side 216 and bottom side 218. The outer section 204 includes a pair of opposite left side subsection **206*a* and right side subsection 206*b*, which can be disposed symmetrically relative to the core section 202 and adhered to the left side 212 and the right side 214 of the core section 202, respectively. For example, the subsections 206*a* and 206*b* are substantially equal in dimensions and weight. The outer section 204 further includes a pair of opposite top subsection 206*c* and bottom subsection 206*d*, which can be disposed symmetrically relative to the core section 202 and adhered to the top side 216 and bottom side 218 of the core section 202 and the top and bottom surfaces of the left side subsection 206*a* and the right side subsection 206*b*, respectively. For example, the subsections 206*c* and 206*d*** are substantially equal in dimensions and weight.

Each of the subsections includes a plurality of elongated material strips stacked and laminated together. The material strips include, but are not limited to, any suitable wood strips, such as maple strips, ash strips, and/or grass strips, such as bamboo strips. The material strips may also includes any suitable combinations of the wood strips and the grass strips. In the shown embodiment, each of the side subsections **206*a* and 206*b* includes a plurality of similar material strips 208 stacked and adhered to each other, along a first direction A. For example, the first direction A can be substantially perpendicular to the top and bottom sides 216 and 218 of the core 202. In the shown embodiment, each of the top and bottom subsections 206*c* and 206*d* also includes a plurality of similar material strips 210 stacked and adhered together, along a second direction B. For example, the second direction B is substantially perpendicular to the left and right sides 212 and 214 of the core 202. In the shown embodiment, the first direction A in which the material strips 208 are arranged is offset from the second direction B in which the material strips 210** are arranged. For example, the first direction A is substantially perpendicular to the second direction B.

The dimensions of the core section 202 and the outer section 204 can vary depending on the specific requirement of the bats. Typically, in order to produce a bat suitable for young players, the core section 202 can be manufactured to have a square section of about 25.4 mm×25.4 mm and a length of about 840 mm; and the final blank 200 with the laminated outer section 204 can be manufactured to have a square section of 76.2 mm×76.2 mm and a length of about 840 mm. Typically, in order to produce a bat suitable for an adult player, the core section 202 can be manufactured to have a square section of about 38.1 mm×38.1 mm and a length of about 914 mm; and the final blank 200 with the laminated outer section 204 can be manufactured to have a square section of 76.2 mm×76.2 mm and a length of about 914 mm.

However, the above sizes and dimensions are just for illustrative purpose, and a person of ordinary skill in the art understands that the blank, the core section, the outer section are not limited to the sizes and dimensions described above. For example, the sizes and dimensions of blank as well as the final bat can be customized according to the specific requirement of a specific user.

Figure 6:
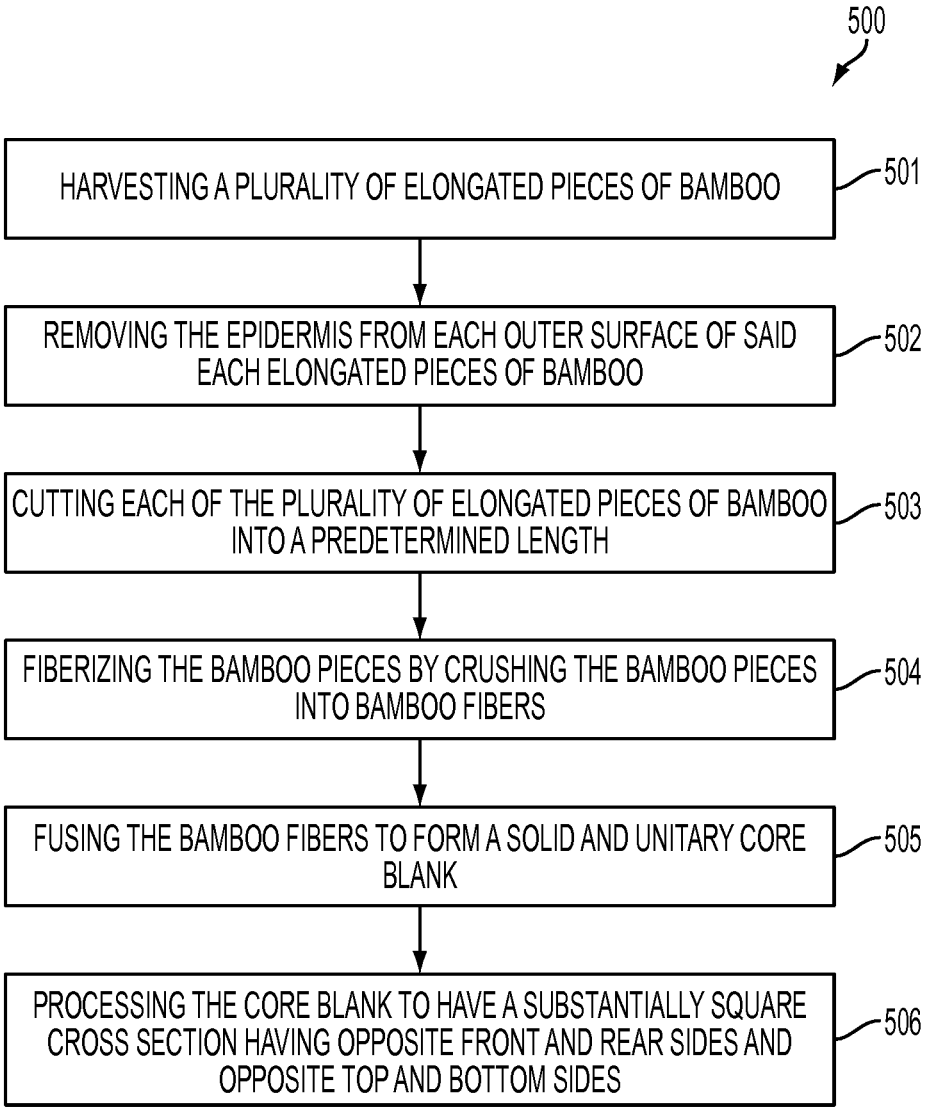
FIG. 6 is a flow chart of a method for forming a fiber-fused core section of a blank.

FIG. 6 illustrates an exemplary method 500 for manufacturing the core section 202. The exemplary method will be described in reference to bamboo as an exemplary grass material. However, a person of ordinary skill in the art understands that the method can also be used to process wood materials including but not limited to maple, ash, birch and/or the combination thereof.

At step 501, a plurality of elongated pieces of bamboo suitable for fabricating core sections of baseball bats are harvested. For example, the bamboo can be harvested when approximately four to five years old and when the diameter of the head of the bamboo is approximately 10-12 cm. After being harvested, the bamboo can be processed as discussed below, for example, within three days.

At step 502, the outer layer of the bamboo pieces, such as epidermis or skin, is removed from each elongated bamboo piece. Removal of the epidermis or skins of the bamboo pieces effectively removes the undesirable materials contained by the epidermis or skins, such as chemical agents contributive to the oxidation of the bamboo materials and a non-adhesive wax layer, which counteracts the fusing of bamboo fibers. Removal of the epidermis or skins of the bamboo pieces can be implemented by any traditional approaches and machinery, such as an abrading machine.

At step 503, the elongated bamboo pieces are cut into segments having a predetermined length suitable for fabricating core sections of baseball bats. At this step, the harvested bamboo is cut to sizes depending on the required different lengths for a particular baseball bat being fabricated. In addition, the cutting step 503 may be implemented prior to or after step 502 for removing the epidermis or skin of the bamboo pieces, depending on the operational circumstance and requirement.

At step 504, the bamboo segments are fiberized by, for example, sufficiently crushing the segments into bamboo fibers. For example, the bamboo segments are roughly crushed by a rolling machine and/or further processed by additional machineries to obtain fine fibers, with the result that the bamboo fibers along the growing direction of the bamboo are substantially fully separated from each other.

At step 505, the resultant bamboo fibers are artificially fused together to form a solid and unitary core blank.

Figure 7:
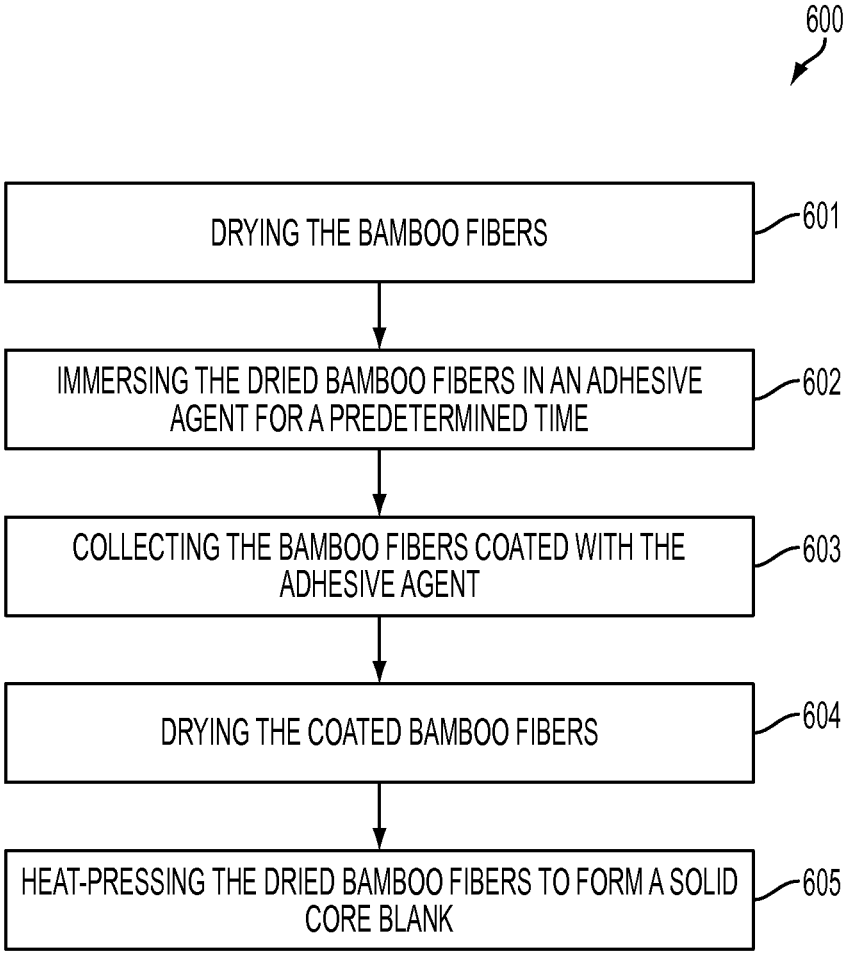
FIG. 7 is a flow chart of a method for fusing wood or grass material fibers.

FIG. 7 illustrates an exemplary process 600 for implementing the fusing step 505. At step 601, the resultant bamboo fibers are dried, for example, in a drying room. For example, the bamboo fibers are dried at 100 degrees Celsius to keep the moisture content of the bamboo fiber at about 10%. At step 602, the dried bamboo fibers are submerged or immersed in an adhesive agent for a predetermined time. At step 603, the bamboo fibers coated or impregnated with the adhesive agent are collected. At step 604, the collected bamboo fibers are subsequently dried. For example, the bamboo fibers coated or impregnated with the adhesive agent are dried at 50 degrees Celsius to keep the moisture content of the bamboo fiber at about 10-15%. At step 605, the dried bamboo fibers coated or impregnated with the adhesive agent are heat-pressed to form a solid and unitary core blank. Step 605 can be implemented by a known Heat Pressure Machine (HPM).

Once the bamboo fibers are artificially fused to provide a solid and unitary core blank, at step 506, the resultant core blank is processed to provide a desirable core section which is subsequently bonded or laminated to an outer section to provide a blank, for which a baseball bat can be fabricated. At this step, the resultant solid and unitary core blank is processed to have a substantially square cross section. In addition, the steps 505 and 506 can be combined and implemented simultaneously. For example, the fusing process of the bamboo fibers can be controlled to provide a predetermined shape and profile to the solid and unitary core blank.

Referring back to FIG. 3-FIG. 5, the blank 200 has a three-layer configuration, with the top subsection 206*c* being the top layer, the core section 202 and the side subsections 206*a* and 206*b* being the middle layer, and the bottom subsection 206*d* being the bottom layer. During the fabricating process, the top layer, middle layer and the bottom layer are formed separately and subsequently bonded or laminated together through, for example, heat-pressing processes.

The structure of a finished baseball bat, according to another aspect of the present invention, will now be described with reference to FIG. 8-FIG. 12.

Figure 8:
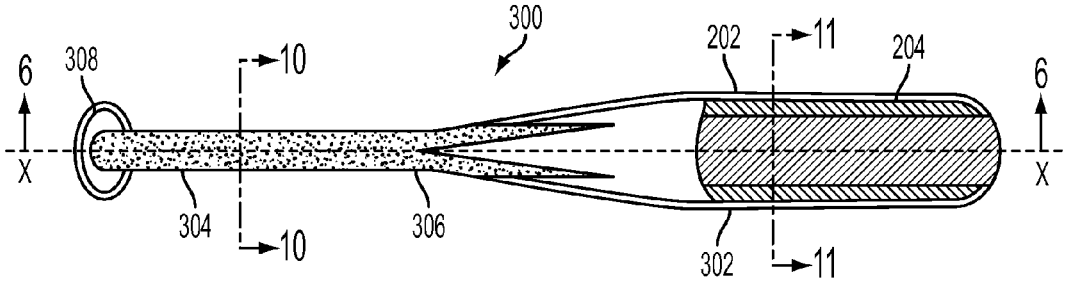
FIG. 8 is a schematic view of a bat according to an exemplary embodiment of the present invention.

FIG. 8 is a schematic view illustrating a bat, identified by reference number 300, which is fabricated from the blank 200 shown in FIG. 3 to FIG. 5. For example, the blank 200 can be passed between shaping and polishing stations for turning, rough polishing, fine polishing and very fine polishing to craft the blank 200 into the shape of the bat 300.

Generally, the bat 300 includes a barrel 302, which is distal to the hands of a user and has the largest cross section along the length of the bat 300. The bat 300 further includes a handle 304 for a user to hold the bat, which is proximal to the user and has the smallest cross section. The bat 300 further includes a middle portion 306 transitioning between the barrel 302 and the handle 304. The middle portion 306 has a curved profile, longitudinally extending between the handle 304 and the barrel 302 and radially expanding from the handle 304 to the barrel 302. Optionally, the bat 300 includes a knob 308 at the proximal end of the handle 304, assisting a user to hold the bat.

Figure 9:
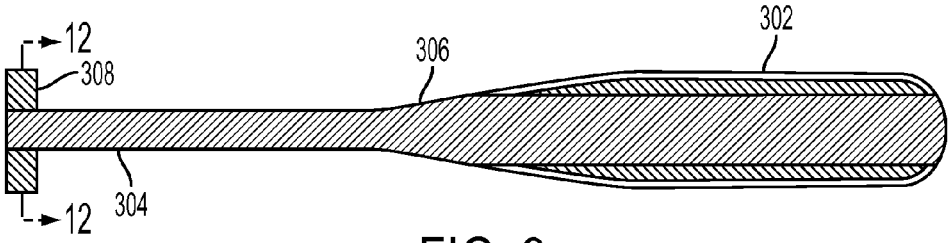
FIG. 9 is a sectional view of the bat in FIG. 8, along lines 9-9.
Figure 10:
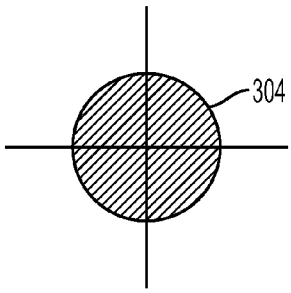
FIG. 10 is a sectional view of the bat in FIG. 8, along lines 10-10.

FIG. 9 is a sectional view along the lines 9-9 in FIG. 8, showing the structure of the bat 300. As shown, the handle 304 is substantially entirely fabricated from the core section 202 through material processing. Thus, the handle 304 is substantially entirely made of artificially fused wood or grass material fibers, which can also be seen in FIG. 10, a section view along lines 10-10 in FIG. 8.

Figure 11:
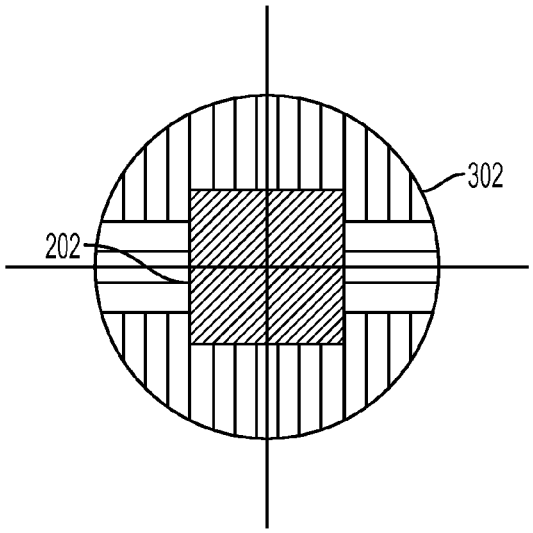
FIG. 11 is a sectional view of the bat in FIG. 8, along lines 11-11.

FIG. 11 is a sectional view along lines 11-11, showing the barrel 302 of the bat 300. The barrel 302 includes a square central portion made from the core section 202 and laminated material strips remained after processing the outer section 204 and substantially surrounding the core section 202. The fiber fused core section 202 improves the strength of the barrel 302 due to its excellent integrity and strength. In light of the improvements to both the barrel 302 and the handle 304, the bat 300 is stronger and less prone to breakage than the similar market accessible products.

Figure 12:
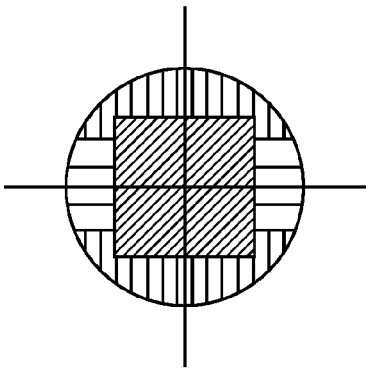
FIG. 12 is a sectional view of the bat in FIG. 8, along lines 12-12.

FIG. 12 is a sectional view along lines 12-12 in FIG. 9, showing the structure of the knob 308. In the shown embodiment, the knob 308, having a relatively larger diameter than that of the handle 304, has a center section made of artificially fused wood or grass material fibers and an outer section made of material strips. However, a person of ordinary skill in the art understands that the knob 308 can be entirely made of artificially fused word or grass material fibers, or alternatively, can be made of other suitable materials.

Figure 13:
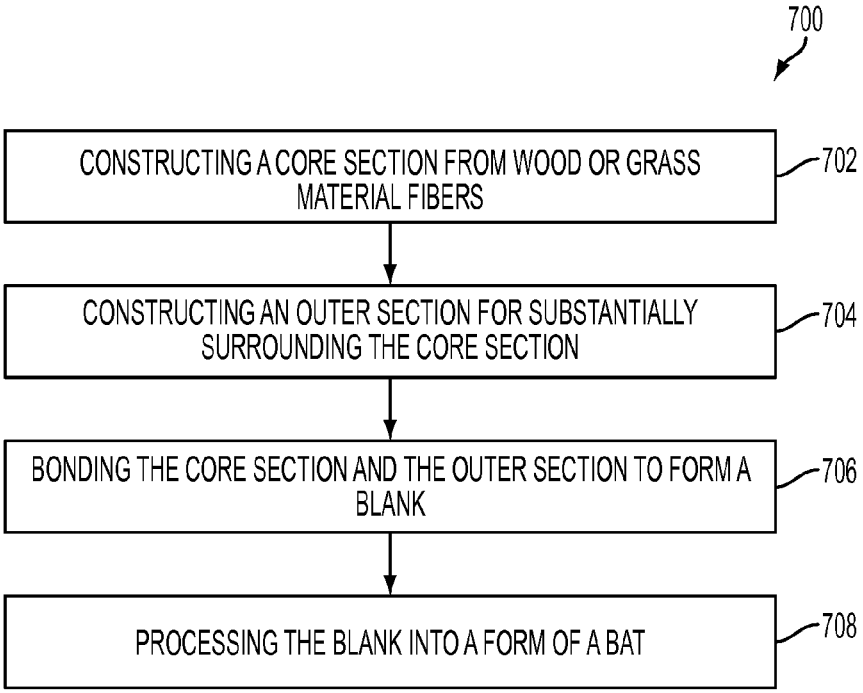
FIG. 13 is a flow chart of a method for forming a bat, such as the bat shown in FIG. 8.

FIG. 13 is a flow chart illustrating a method 700 for manufacturing the bat 300, according to another aspect of the present invention.

At step 702, a core section, such as the core section 202, for a bat is fabricated exclusively from wood or grass material fibers. The wood or grass material fibers are artificially fused together, for example, through the processes shown in FIG. 6 and FIG. 7. For example, the core section is formed to have a substantially square cross section having opposite left and right sides and opposite top and bottom sides.

At step 704, an outer section for a bat is fabricated according to a known method. For example, the outer section is formed from wood or grass material strips laminated together to have a pair of side subsections and a pair of top and bottom subsections.

At step 706, the outer section is bonded to the core section to form a blank. For example, the side subsections of the outer section are adhered to the left and right sides of the solid core blank, respectively; and the top and bottom subsections of the outer section are adhered to the top and bottom sides of the solid core blank, respectively.

At step 708, the bat blank is shaped into a form of a base bat. This step can include shaping the blank into the form of a bat, polishing the bat and finishing the bat. For example, the shaping the blank into the form of a bat can include lathing or turning the blank into the form of a bat, such as a baseball bat.

FIG. 14-FIG. 18 illustrate a bat 400 extending along a longitudinal axis X-X', according to another exemplary embodiment of the present invention. For example, the bat 400 is fabricated from the blank 200 shown in FIG. 3 to FIG. 5. The bat 400 includes a barrel 402 having the largest cross section along the length of the bat, a handle 404 having the smallest cross section along the length of the bat, and a middle portion 406 transitioning between the barrel 402 and the handle 404. The middle portion 406 has a curved profile, longitudinally extending between the handle 404 and the barrel 402 and radially expanding from the handle 404 to the barrel 402. In this embodiment, the bat 400 further includes an insert 800 disposed in the distal end of the barrel 402, which will be described in detail. Optionally, the bat 400 includes a knob 407 at the proximal end of the handle 404, assisting a user to hold the bat.

Figure 14:
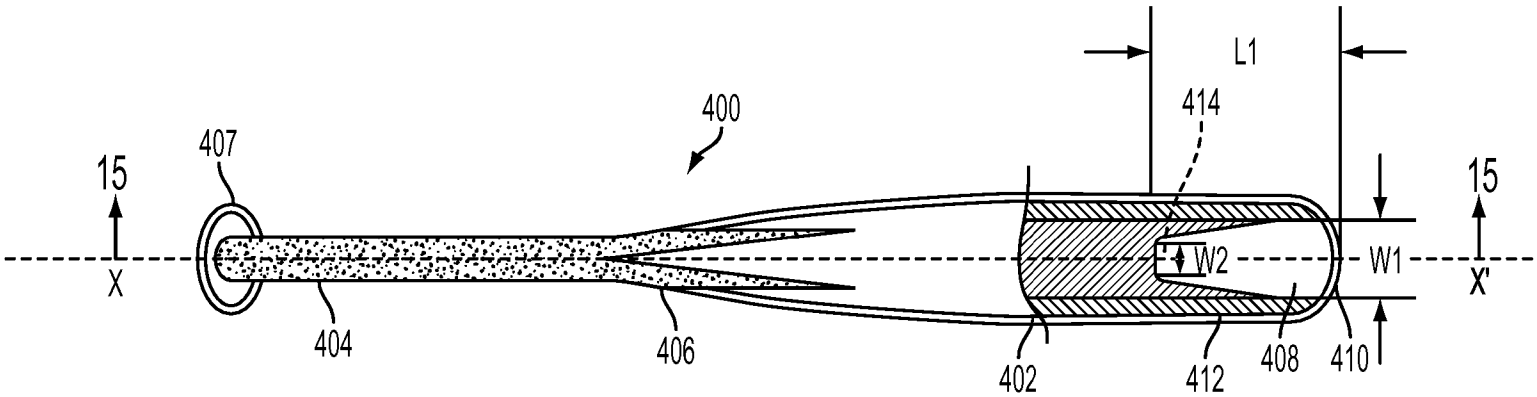
FIG. 14 is a schematic view of a bat according to another exemplary embodiment of the present invention.

FIG. 14 is a schematic view of the bat 400, with a part of the barrel 402 taken away to better illustrate the inner structure of the bat. In FIG. 14, the insert 800 is also taken away to better illustrate a void 408 formed at a distal end portion of the barrel 402. The void 408 is substantially elongated and extends proximally toward the knob 407 from a distal outer surface 410 of the barrel 402. In this embodiment, the distal outer surface of the barrel 402 is a convex surface.

The void 408 provides an open space in the distal end portion of the barrel 402 for receiving the insert 800, which is structurally complementary to the void 408. For example, the dimensions of the void 408 and the insert 800 are configured to allow the insert 800 be fixedly placed in the void 408 to improve integrity of the bat. For example, the void 408 can be in the form of a drill hole, a recess, a groove, a carve-out and the like.

The insert 800 is made of a wood or grass material different from the material forming the core section 202 of the bat 400 running through the entire length of the bat 400, so that the weight of the bat along its length can be balanced to assist a user to achieve a stable swing. The material for the insert 800 can be selected from a wide varieties of materials, including but not limited to, bamboo, birch, maple, ash and the like. It has been discovered by the inventors that it is particularly beneficial, when the core section 202 of the bat 400 is made exclusively of bamboo fibers artificially fused together and the outer section 204 of the bat 400 is made of bamboo stripes, the insert 800 is made of a wood material such as maple wood.

As shown in FIG. 14, the void 408 is defined by an inner side surface 412 and an inner end surface 414 connecting the inner side surface 412 at the circumference thereof. In the shown embodiment, the void 408 can be substantially trapezoidal or tapered in its cross section along the longitudinal axis X-X' of the bat 400, such that the void 408 is substantially cone shaped. The inner end surface 414 can be a flat surface or a curved surface. The void 408 is radially centered along the longitudinal axis X-X' of the bat 400.

Figure 17:
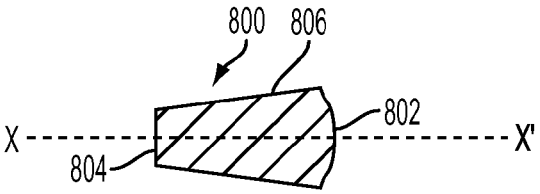
FIG. 17 is a sectional view of an insert of the bat in FIG. 14.

FIG. 17 is a sectional view of the insert 800. The insert 800 includes a curved distal surface 802, which forms a continuous round end profile of the bat 400 together with the outer surface 410 of the bat 400 once the insert 800 is fully placed into the void 408. The insert 800 further includes a proximal surface 804 substantially complementary to the inner end surface 414 of the void 408, and a side surface 806 connecting the distal surface 802 and the proximal surface 804. The side surface 806 of the insert is substantially complementary to the inner side surface 412 of the void 408.

However, a person of ordinary skill in the art understands that the complementary profiles of the insert and the void can vary without departing from the spirit of the invention. For example, the insert and the void can be substantially cylindrical, bulb-shaped, conical or square.

Figure 16:
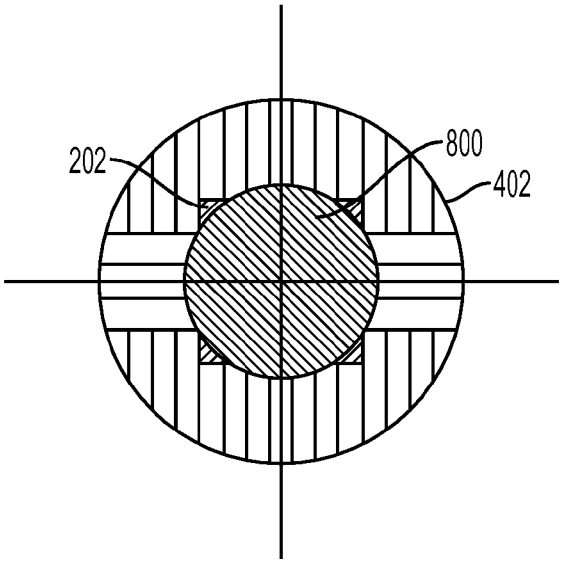
FIG. 16 is a sectional view of the bat in FIG. 15, along lines 16-16.

FIG. 16 is a side view of the distal end of the bat 400 showing the positional relationship of the insert 800 and the core section 202 of the bat 400. As shown, both the insert 800 and the core section 202 are centered along the longitudinal axis X-X'. In addition, the insert 800 is dimensioned to allow the core section 202 to be exposed at the four corners thereof.

As shown in FIG. 14, for example, the void 408 and the insert 800 can be formed to have a linear width W1, at the outer surface 410, of about 25.4-38.1 mm, a liner width W2, at the inner end surface 414, of about 19 mm and a linear length L1 along the axis X-X' of about 51-76 mm. However, a person of ordinary skill in the art understands that the above dimensions are for illustrative purpose and can be varied depending the specific requirement of the bat. In addition, the various dimensions of the bat, such as the entire length of the bat, the length of the handle, the diameter of the barrel, can be changed or adjusted, when the bat is used as a baseball bats, a softball bat, a fungo bat, a training bat and the like respectively.

Measures can be taken to ensure that the insert 800 is secured in the void 408 in a sealed manner. For example, adhesives can be applied to the proximal surface 804 and the side surface 806 of the insert 800 to create an adhesive bonding between the insert 800 and the barrel 402 of the bat 400.

Figure 15:
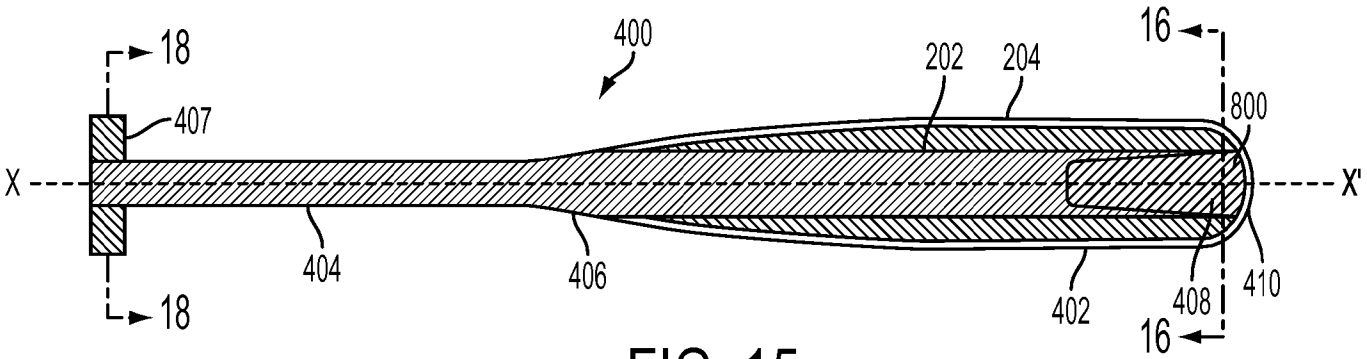
FIG. 15 is a sectional view of the bat in FIG. 14, along lines 15-15.
Figure 18:
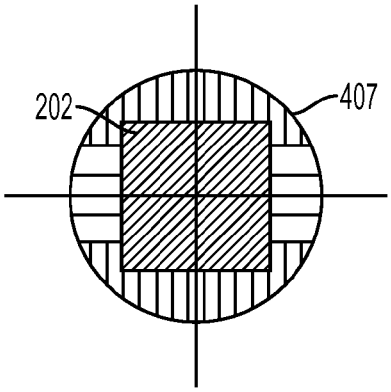
FIG. 18 is a sectional view of the bat in FIG. 15, along lines 18-18.

FIG. 18 is a sectional view along lines 18-18 in FIG. 15, showing the structure of the knob 407. In the shown embodiment, the knob 407, having a relatively larger diameter than that of the handle 404, has a center section made of artificially fused wood or grass material fibers and an outer section made of material strips. However, a person of ordinary skill in the art understands that the knob 407 can be entirely made of artificially fused word or grass material fibers, or alternatively, can be made of other suitable materials.

Figure 19:
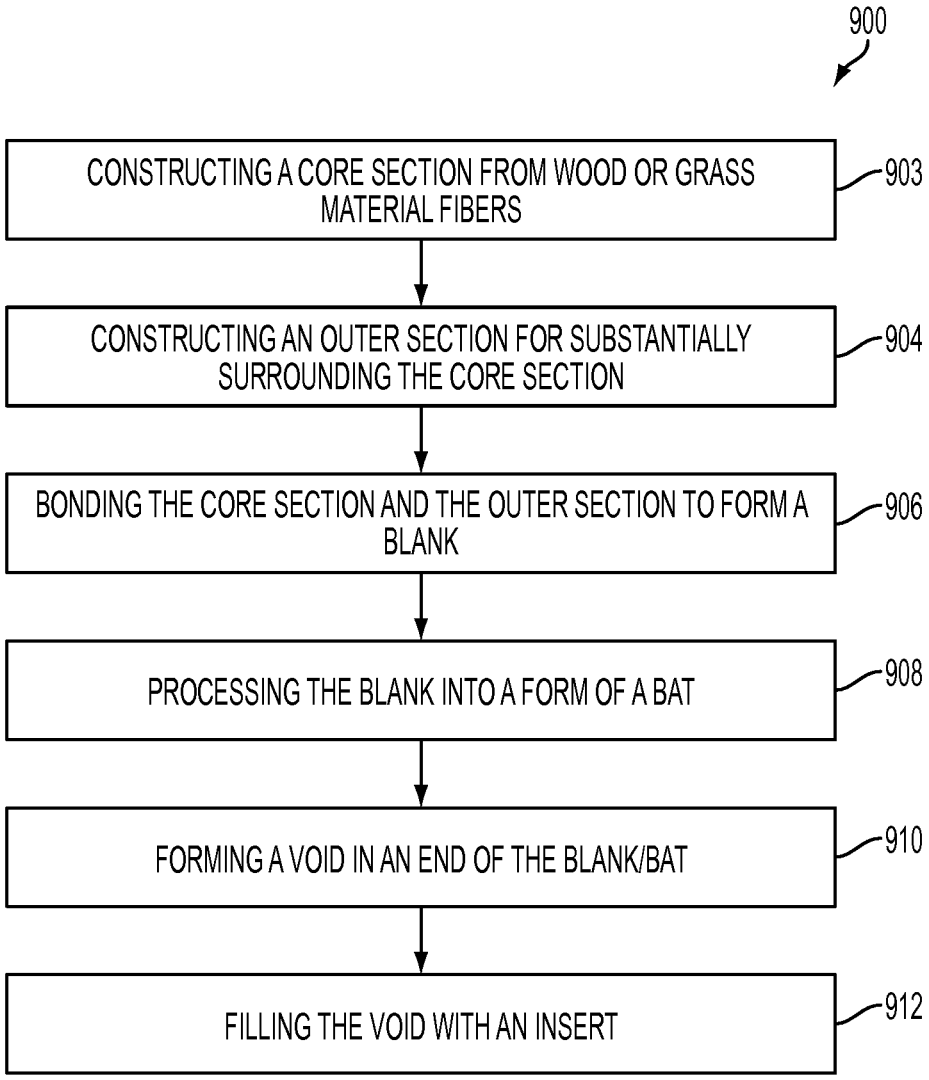
FIG. 19 is a flow chart of a method for forming a bat, such as the bat shown in FIG. 14.

FIG. 19 is a flow chart illustrating a method 900 for manufacturing a bat, according to a further aspect of the present invention.

At step 903, a core section for a bat is constructed exclusively from wood or grass material fibers artificially fused together. For example, the core section consists of bamboo fibers artificially fused together. For example, the core section is formed to have a substantially square cross section having opposite left and right sides and opposite top and bottom sides.

At step 904, an outer section configured to substantially surround the core section is constructed. For example, the outer section is formed of wood or grass material strips laminated together to provide a pair of side subsections and a pair of top and bottom subsections.

At step 906, the outer section is bonded to the core section to form a blank. For example, the side subsections of the outer section are adhered to the left and right sides of the core section respectively; and the top and bottom subsections of the outer section are adhered to the top and bottom sides of the core section, respectively.

At step 908, the blank is shaped into a form of a bat. This step can include shaping the blank into the form of a bat, polishing the bat and finishing the bat.

At step 910, a void is formed in a distal end portion of the bat/blank. The void is formed centered along the longitudinal axis of the bat. For example, this step can be implemented by lathing the distal end portion of the bat to provide a centered void.

At step 912, the void is filled with an insert made of a wood or grass material different from that of the blank. The dimension and shape of the insert is substantially complementary to that of the void. The sequence of the step 908 and the steps 910/912 can be reversed, in which case the void is formed in a distal end portion of the blank.

Figure 20:
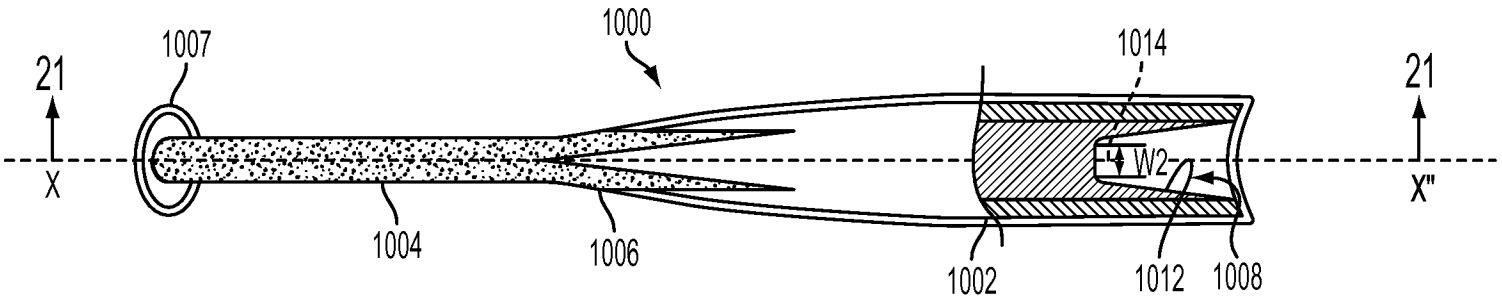
FIG. 20 is a schematic view of a bat according to still another exemplary embodiment of the present invention.
Figure 21:
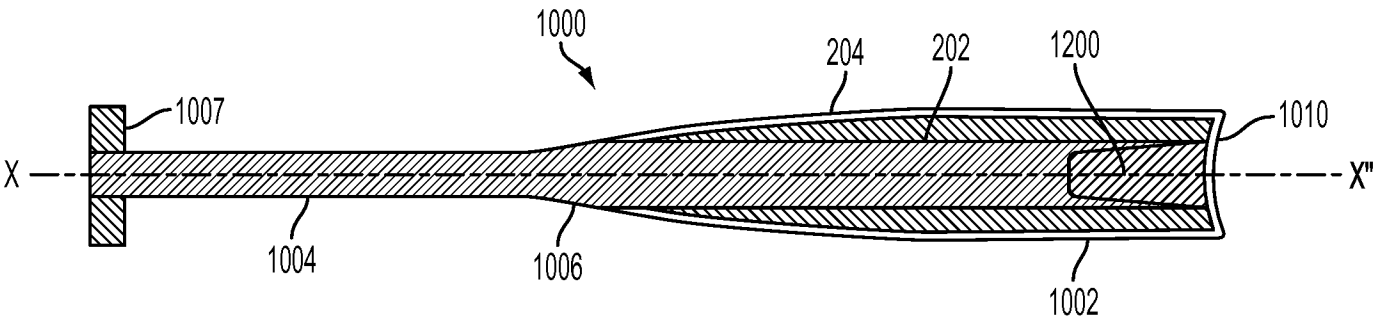
FIG. 21 is a sectional view of the bat in FIG. 20, along lines 21-21.
Figure 22:
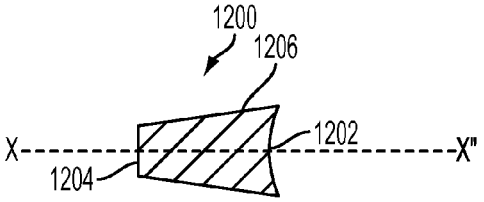
FIG. 22 is a sectional view of an insert of the bat in FIG. 20.
Figure 26:
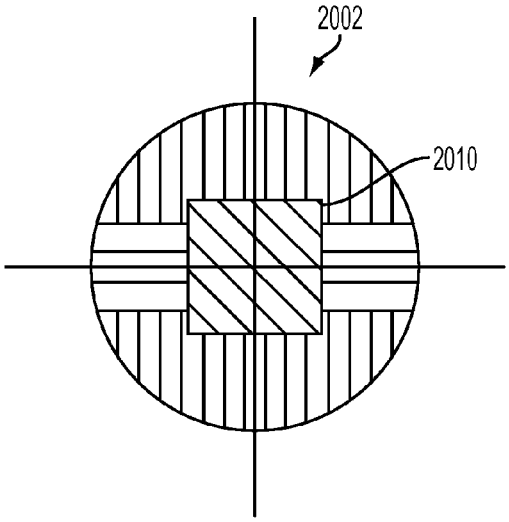
FIG. 26 is a sectional view of the bat in FIG. 23, along lines 26-26.

FIG. 20-FIG. 22 illustrate a bat 1000 extending along a longitudinal axis X-X", according to another exemplary embodiment of the present invention. The bat 1000 includes a barrel 1002 having the largest cross section along the length of the bat, a handle 1004 having the smallest cross section along the length of the bat, and a middle portion 1006 transitioning between the barrel 1002 and the handle 1004. The middle portion 1006 has a curved profile, longitudinally extending between the handle 1004 and the barrel 1002 and radially expanding from the handle 1004 to the barrel 1002. In this embodiment, the bat 1000 further includes an insert 1200 disposed in a distal end portion of the barrel 402, which will be described in detail. Optionally, the bat 1000 includes a knob 1007 at the end of the handle 1004, assisting a user to hold the bat. In this embodiment, the barrel 1002 has a distal outer surface 1010, which is a concave surface.

The bat 1000 has a void 1008 formed in the distal end portion of the barrel 1002. The void 1008 is substantially elongated and extends proximally toward the knob 1007 from the concave distal outer surface 1010 of the barrel 1002. The void 1008 provides an open space in the distal end portion of the barrel 1002 for receiving the insert 1200, which is shaped structurally complementary to the void 1008. For example, the dimensions of the void 1008 and the insert 1200 are configured to fixedly place the insert 1200 in the void 1008 to improve integrity of the bat. For example, the void 408 can be in the form of a drill hole, a recess, a groove, a carve-out and the like.

The insert 1200 is made of a wood or grass material different from the material forming the core section 202 of the bat 1000 running through the entire length of the bat, so that the weight of the bat along its entire length can be balanced to assist a user to achieve a stable swing. The material for the insert 1200 can be selected from a wide varieties of materials, including but not limited to, bamboo, birch, maple, ash and the like. It has been discovered by the inventors that it is particularly beneficial, when the core section of the bat 1000 is made exclusively of bamboo fibers artificially fused together and the outer section of the bat 1000 is made of bamboo stripes, the insert 1200 is made of a wood material, such as maple wood.

As shown in FIG. 20, the void 1008 is defined by an inner side surface 1012 and an inner end surface 1014 connecting the inner side surface 1012 at the circumference thereof. In the shown embodiment, the void 1008 can be substantially trapezoidal or tapered in its cross section along the longitudinal axis X-X" of the bat 1000, such that the void 1008 is substantially cone shaped. The inner end surface 1014 can be a flat surface or a curved surface. The void 1008 is radially centered along the longitudinal axis X-X" of the bat 1000.

FIG. 22 is a sectional view of the insert 1200. The insert 1200 includes a concavely curved distal surface 1202, which forms a continuous concave end profile of the bat 1000 together with the outer surface 1010 of the bat 1000 once the insert 1200 is fully placed into the void 1008. The insert 1200 further includes a proximal surface 1204 substantially complementary to the inner end surface 1014 of the void 1008, and a side surface 1206 connecting the distal surface 1202 and the proximal surface 1204. The side surface 1206 of the insert is substantially complementary to the inner side surface 1012 of the void 1008.

The process for manufacturing the bat 1000 is similar to the process for manufacturing the bat 400.

Figure 23:
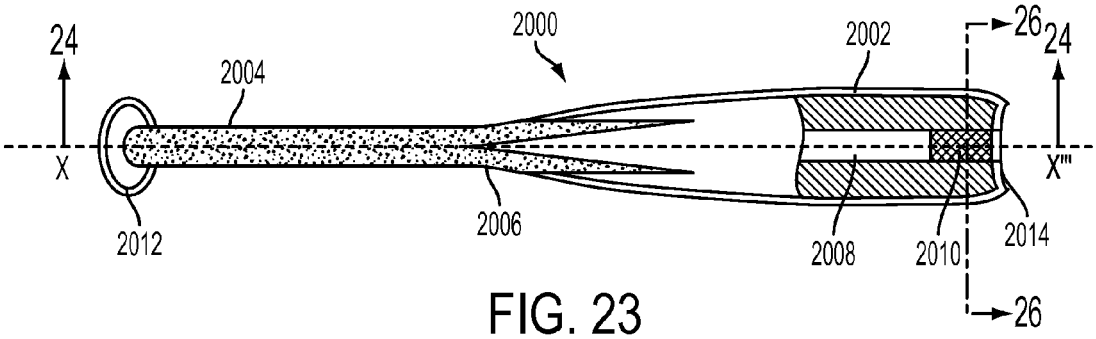
FIG. 23 is a schematic view of a bat according to yet another exemplary embodiment of the present invention.
Figure 24:
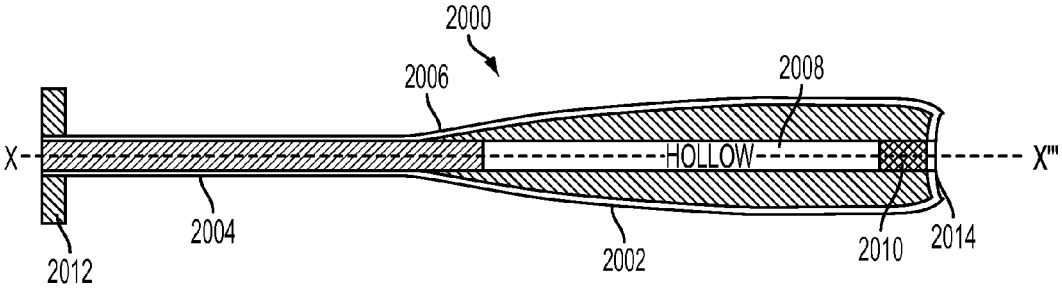
FIG. 24 is a sectional view of the bat in FIG. 23, along lines 24-24.
Figure 25:
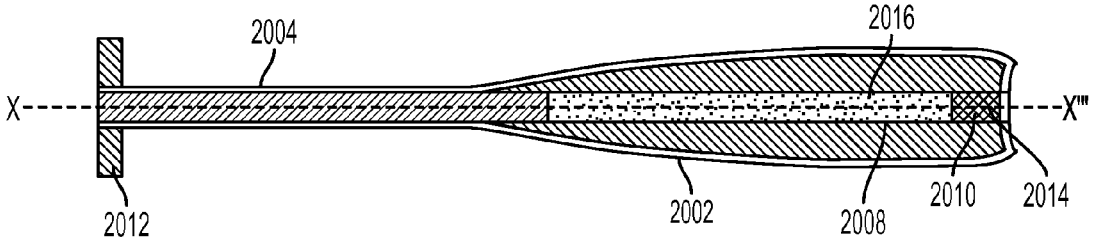
FIG. 25 is a section view showing an alternative structure of the bat shown in FIG. 24.

FIG. 23-FIG. 26 illustrate a bat 2000 according to another exemplary embodiment of the present invention. The bat 2000 extends longitudinally along an axis X-X'". Similarly, the bat 2000 includes a barrel 2002 having the largest cross section along the length of the bat, a handle 2004 having the smallest cross section along the length of the bat, and a middle portion 2006 transitioning between the barrel 2002 and the handle 2004. The middle portion 2006 has a curved profile, longitudinally extending between the handle 2004 and the barrel 2002 and radially expanding from the handle 2004 to the barrel 2002. In this embodiment, the bat 2000 has an inner space 2008, which makes the bat hollow. Alternatively, the inner space 2008 can be filled with foam or foam-like material 2016, as shown in FIG. 25. The bat 2000 further includes a plug 2010 disposed in the distal end portion of the barrel 2002. The plug 2010 can be made of wood materials. The bat 2000 can further include a knob 2012 at the proximal end of the handle 2004, assisting a user to hold the bat. In this embodiment, the barrel 2002 has a distal outer surface 2014, which is a concave surface. Alternatively, the distal outer surface can be a convex surface.

Figure 27:
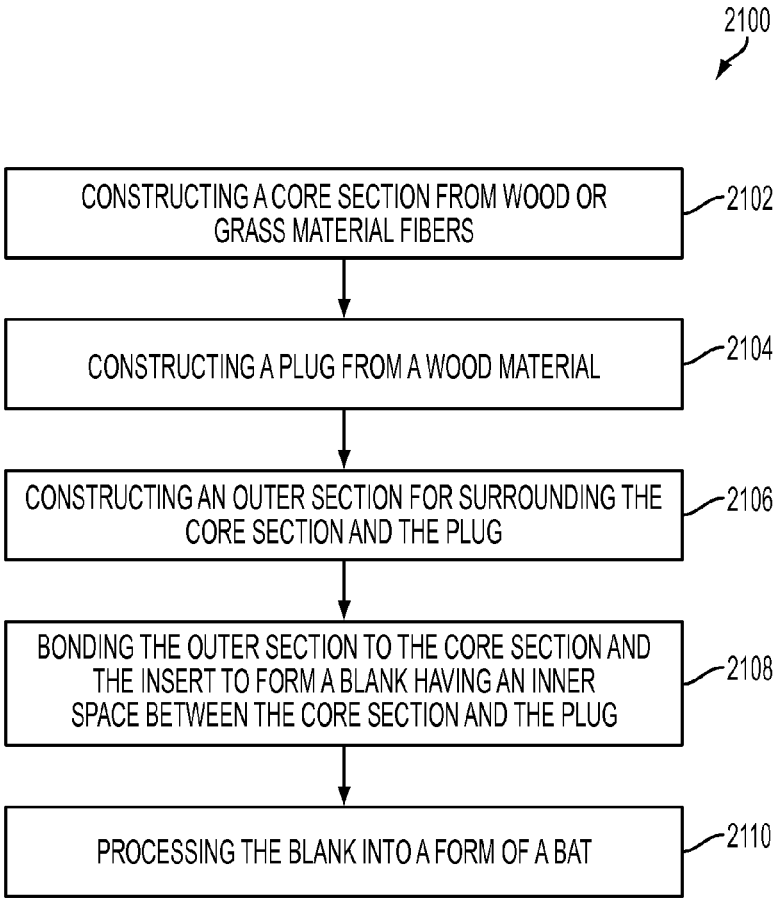
FIG. 27 is a flow chart of a method for forming a bat, such as the bat shown in FIG. 23.

FIG. 27 illustrates a method 2100 for manufacturing the bat 2000.

In step 2102, a fiber-fused core section is constructed from wood or grass material fibers. The core section can be formed through the process shown in FIG. 6 and FIG. 7. For example, the core section can be formed to have a substantially square cross section having opposite top and bottom sides and opposite left and right sides.

In step 2104, a plug is formed from, for example, a wood material, such as maple. The plug can be formed to have a same or similar cross section as that of the core section of the blank. For example, the plug can be formed to have a substantially square cross section having opposite top and bottom sides and opposite left and right sides In step 2106, an outer section is formed, which is configured to substantially surround both the core section and the plug to form a blank. For example, the outer section can be formed by laminating a plurality of wood or grass material strips to provide a top subsection, a bottom subsection, a left subsection and a right subsection. The above steps 2102-2106 can be implemented in any suitable order.

In step 2108, the outer section is bonded to both the core section and the insert to form a blank with an inner space provided between the core section and the plug. For example, the outer section can be bonded to the core section and the plug by bonding the top subsection, the bottom subsection, the left subsection and the right subsection to the top side, the bottom side, the left side and the right side of the core section and the plug, respectively. In this step, the inner space between the core section and the plug can be alternatively filled with a foam or foam-like material, prior to the final subsection of the outer section is bonded to a corresponding side of the core section and the plug.

In step 2110, the blank is processed into a form of a bat, such as the bat 2000 shown in FIGS. 23-25. For example, the bat 2000 can have an entire length of about 31-34 inches; the fiber-fused core section of the bat can have a length of about 16 inches; the hollow part of the bat can have a length of about 13-15 inches; the plug 2010 can have a length of about 3 inches; the square core section and the insert can have a lateral dimension of 0.75 inches×0.75 inches; and the barrel 2002 and the knob 2012 can have a diameter of 2.5 inches. However, a person of ordinary skill in the art understands that the above dimensions are just for illustrative purpose and can be varied according to the specific requirement of the bat.

It has been discovered by the inventors that the following material combination is particularly beneficial: the core section of the bat consists of bamboo fibers artificially fused together, the outer section of the bat is made of bamboo stripes laminated together and the plug is made of a wood material, such as maple wood.

The bats according to the above exemplary embodiments of the invention have a balanced weight throughout its entire length, which makes the entire bat practically a "sweet-spot" and effectively improves the players' performance.

The bats according to the above exemplary embodiments of the invention have a stronger handle than similar market accessible bats and thus are less prone to breakage. Particularly, the core section formed exclusively of artificially fused bamboo fibers offers a stronger, solid and unitary core substantially running through bat. Furthermore, the three-layer configuration of the bat with a unified core in the center offers excellent symmetricalness of the bats.

The bats according to the above exemplary embodiments of the invention have shown a longer life span, which in turn saves the materials used for manufacturing the bats and protects the environment. The dimensions of the above-described bats are given by way of example only and not to limit the scope of the present invention.

The bats according to the above exemplary embodiments of the invention can be used for different age groups and all types of bats. For example, the bats can be used for youth models, softball models, baseball models and training bat models.

Although described with regard to baseball bats, the methods and articles described herein can be applied to any elongated wooden articles, such as lacrosse sticks, hockey sticks, axe handles, shovel handles and the like.

While the exemplary embodiments of the present invention have been shown and described, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. An elongated article extending along a longitudinal axis and having a distal end and a proximal end along the axis, the article comprising:

an elongated core section extending along the axis, the core section consisting of a plurality of material fibers, each material fiber having a surrounding adhesive coating for bonding the material fibers together;

an outer section extending along the axis, the outer section substantially surrounding the core section;

a void in a distal end portion of the article; and an insert disposed in the void, wherein the core section comprises a substantially square cross section having opposite left and right sides and opposite top and bottom sides, and wherein the article comprises a bat and wherein the core section of the bat consisting of a plurality of bamboo fibers fused together and the insert of the bat is made of a wood material.

2. The article of claim 1, wherein the outer section comprises: a pair of side subsections adhered to the left and right sides of the core section, respectively; and a pair of top and bottom subsections adhered to the top and bottom sides of the core section, respectively.

3. An elongated article extending along a longitudinal axis and having a distal end and a proximal end along the axis, the article comprising:

an elongated core section extending along the axis, the core section consisting of a plurality of material fibers, each material fiber having a surrounding adhesive coating for bonding the material fibers together;

a plug longitudinally distanced from the core section; and an outer section extending along the axis, the outer section substantially surrounding the core section and the plug to define an inner space between the core section and the plug, wherein the core section comprises a substantially square cross section having opposite left and right sides and opposite top and bottom sides, and wherein the article comprises a bat and wherein the core section of the bat consisting of a plurality of bamboo fibers fused together and the plug of the bat is made of a wood material.

4. The article of claim 3, wherein the outer section comprises: a pair of side subsections adhered to the left and right sides of the core section, respectively; and a pair of top and bottom subsections adhered to the top and bottom sides of the core section, respectively.

5. The article of claim 4, wherein the inner space is filled with a foam material.

6. A method of forming an elongated article, the method comprising:

constructing a core section by crushing at least one material piece into a plurality of fibers and fusing the plurality of fibers;

constructing an outer section for substantially surrounding the core section;

bonding the outer section to the core section to form a blank;

processing the blank into a predetermined form of the article having a distal end and a proximal end;

forming a void in a distal end portion of the article; and filling the void with an insert, wherein the constructing of the core section comprises constructing the core section to have a substantially square cross section having opposite left and right sides and opposite top and bottom sides, and wherein the constructing of the core section comprises crushing a bamboo piece into a plurality of fibers and fusing the plurality of bamboo fibers to form the core section and the filling of the void with an insert comprises forming the insert from a wood material.

7. The method of claim 6, wherein the method is for forming a bat and the processing of the blank into a predetermined form comprises processing the blank into a form of a bat.

8. The method of claim 6, wherein the constructing of the outer section comprises constructing the outer section to comprise: a pair of side subsections adhered to the left and right sides of the core section, respectively; and a pair of top and bottom subsections adhered to the top and bottom sides of the core section, respectively.

9. A method of forming an elongated article, the method comprising:

constructing a core section by crushing at least one material piece into a plurality of fibers and fusing the plurality of fibers;

constructing a plug;

constructing an outer section for substantially surrounding the core section and the plug;

bonding the outer section to the core section and plug to form a blank having an inner space between the core section and the plug; and processing the blank into a predetermined form of the article having a distal end and a proximal end, wherein the constructing of the core section comprises constructing the core section to have a substantially square cross section having opposite left and right sides and opposite top and bottom sides, and wherein the constructing of the core section comprises crushing a bamboo piece into a plurality of fibers and fusing the plurality of bamboo fibers to form the core section and the constructing of the plug comprises constructing the plug from a wood material.

10. The method of claim 9, wherein the method is for forming a bat and the processing of the blank into a predetermined form comprises processing the blank into a form of a bat.

11. The method of claim 9, wherein the constructing of the outer section comprises constructing the outer section to comprise: a pair of side subsections adhered to the left and right sides of the core section, respectively; and a pair of top and bottom subsections adhered to the top and bottom sides of the core section, respectively.

12. The method of claim 9, further comprising filling the inner space with a foam material.

* * * * *